US007848679B2

(12) United States Patent
Kanai et al.

(10) Patent No.: US 7,848,679 B2
(45) Date of Patent: Dec. 7, 2010

(54) IMAGE FORMING APPARATUS

(75) Inventors: Ryosuke Kanai, Numazu (JP); Yosuke Kishi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 178 days.

(21) Appl. No.: 12/324,807

(22) Filed: Nov. 26, 2008

(65) Prior Publication Data

US 2009/0169227 A1 Jul. 2, 2009

(30) Foreign Application Priority Data

Dec. 26, 2007 (JP) ..... 2007-334012
Sep. 22, 2008 (JP) ..... 2008-242197

(51) Int. Cl.
*G03G 21/00* (2006.01)

(52) U.S. Cl. ..... 399/128

(58) Field of Classification Search ..... 339/128, 339/50, 51, 52, 31, 174, 175
See application file for complete search history.

(56) References Cited

U.S. PATENT DOCUMENTS 4,821,068 A * 4/1989 Honma et al. ..... 399/51
4,841,328 A * 6/1989 Takeuchi et al. ..... 399/220
5,568,231 A * 10/1996 Asano et al. ..... 399/175
5,956,548 A * 9/1999 Hattori ..... 399/168
6,125,246 A * 9/2000 Hashimoto ..... 399/50
6,212,339 B1 * 4/2001 Inoue et al. ..... 399/18
6,233,416 B1 * 5/2001 Kinosita et al. ..... 399/128
6,259,869 B1 * 7/2001 Abe et al. ..... 399/50
6,332,064 B1 * 12/2001 Sato et al. ..... 399/50
6,345,159 B1 * 2/2002 Suzuki ..... 399/50
2001/0024580 A1 * 9/2001 Kusunose ..... 399/111
2007/0140714 A1 * 6/2007 Kurita et al. ..... 399/44

FOREIGN PATENT DOCUMENTS

JP 11-174755 A 7/1999
JP 2004-334063 A 11/2004

* cited by examiner

*Primary Examiner*—David P Porta
*Assistant Examiner*—Kiho Kim
(74) *Attorney, Agent, or Firm*—Canon U.S.A., Inc. I.P. Division

(57) ABSTRACT

An image forming apparatus includes a standard exposure device (1) adjusted to emit light of a predetermined light quantity, and a control device configured to determine light quantity of the pre-charge exposure device in an image-forming period based on the first and the second charging current values, wherein first charging current value is detected when an area on a photosensitive member surface is recharged by the contact charging member, in a case where the photosensitive member is exposed by turning on the standard exposure device without turning on a pre-charge exposure device, and second charging current value is detected when an area on the photosensitive member surface is recharged by the contact charging member, in a case where the photosensitive member charged by applying a predetermined voltage by the contact charging member is exposed by turning on the pre-charge exposure device without turning on the standard exposure device.

8 Claims, 7 Drawing Sheets

FIG. 6

DRUM A

| PRE-CHARGE EXPOSURE LIGHT QUANTITY[lx*s] | 0.5 | 0.9 | 1.2 | 1.4 | 1.6 | 1.9 | 2.1 | 2.3 |
|---|---|---|---|---|---|---|---|---|
| Ic[μA] | 12 | 21 | 25 | 29 | 33 | 37 | 40 | 43 |
| Ico[μA] | 54 | 54 | 54 | 54 | 54 | 54 | 54 | 54 |
| Ic/Ico | 0.22 | 0.39 | 0.46 | 0.54 | 0.61 | 0.69 | 0.74 | 0.80 |
| GHOST | YES | SLIGHT | NO | NO | NO | NO | NO | NO |
| TONER SCATTERING | NO | NO | NO | NO | NO | SLIGHT | YES | YES |

DRUM B

| PRE-CHARGE EXPOSURE LIGHT QUANTITY[lx*s] | 0.5 | 0.9 | 1.2 | 1.4 | 1.6 | 1.9 | 2.1 | 2.3 |
|---|---|---|---|---|---|---|---|---|
| Ic[μA] | 25 | 44 | 53 | 61 | 69 | 78 | 84 | 90 |
| Ico[μA] | 119 | 119 | 119 | 119 | 119 | 119 | 119 | 119 |
| Ic/Ico | 0.21 | 0.37 | 0.44 | 0.51 | 0.58 | 0.65 | 0.71 | 0.76 |
| GHOST | YES | SLIGHT | NO | NO | NO | NO | NO | NO |
| TONER SCATTERING | NO | NO | NO | NO | NO | SLIGHT | SLIGHT | YES |

DRUM C

| PRE-CHARGE EXPOSURE LIGHT QUANTITY[lx*s] | 0.8 | 1.1 | 1.5 | 1.9 | 2.3 | 2.7 | 3.1 | 3.5 |
|---|---|---|---|---|---|---|---|---|
| Ic[μA] | 12 | 16 | 22 | 26 | 30 | 35 | 38 | 41 |
| Ico[μA] | 52 | 52 | 52 | 52 | 52 | 52 | 52 | 52 |
| Ic/Ico | 0.23 | 0.31 | 0.42 | 0.50 | 0.58 | 0.67 | 0.73 | 0.79 |
| GHOST | YES | SLIGHT | NO | NO | NO | NO | NO | NO |
| TONER SCATTERING | NO | NO | NO | NO | NO | SLIGHT | SLIGHT | YES |

IMAGE FORMING APPARATUS

BACKGROUND OF THE INVENTION

1. Field of the Invention

The present invention relates to an image forming apparatus employing an electrophotographic method.

2. Description of the Related Art

Conventionally, image forming apparatuses are known that employ an electrophotographic method, such as an electrophotographic copier, an electrophotographic printer (e.g., light-emitting diode (LED) printer, laser beam printer, etc.), and an electrophotographic facsimile machine.

The image forming apparatus of this type includes a charging device which uniformly charges a surface of an electrophotographic photosensitive member and an image exposure device which exposes the charged surface of the electrophotographic photosensitive member to light to form an electrostatic latent image. The electrophotographic photosensitive member is drum-shaped or endless-belt-shaped and can be rotated at a predetermined speed. The electrophotographic photosensitive member used in electrophotography is hereinafter referred to as a photosensitive drum or a drum.

The electrostatic latent image is formed into a toner image by a development device using developer (hereinafter referred to as toner). The toner image is transferred to a transfer material by a transfer device. Subsequently, the toner image is fixed onto the transfer material as a fixed image by a fixing device. Residual transfer toner remains on the surface of the photosensitive drum after the toner image is transferred to the transfer material. The residual transfer toner is removed by a cleaning device and then the photosensitive drum prepares for the next image forming operation.

In recent years, many image forming apparatuses use a charging device employing a contact charging method. Most of such charging devices use a conductive roller of a roller-charging-type as a contact charging member, to which a voltage is applied. The conductive roller of the roller-charging-type is classified into two types. One employs a direct current (DC) system which uses only a direct current voltage as a charging voltage. The other employs an alternate current (AC) superposition system which applies a voltage whose DC and AC components are superposed.

The AC superposition system is capable of uniformly charging a photosensitive drum surface. However, in the AC superposition system, electrical discharge occurs in a micro gap between the contact charging member and the photosensitive drum, which shortens a life of the photosensitive drum. This is because the discharge causes damage to the photosensitive drum surface and increases abrasion loss of the photosensitive drum.

On the other hand, the DC system discharges less energy in the micro gap between the contact charging member and the photosensitive drum. Thus, the damage to the photosensitive drum is a little and the life of the photosensitive drum can be increased compared to the AC superposition system. Accordingly, from a viewpoint of increasing the life of the photosensitive drum, the DC system is suitable for charging the photosensitive drum. However, there have been the following problems in charging the photosensitive drum particularly with the DC system.

After an image is formed, a surface potential of the photosensitive drum may not be uniform due to an image pattern that has been formed on the surface. If the next charging is performed in this state, the photosensitive drum surface may not be uniformly charged depending on the image which was formed in the preceding image forming. As a result, the surface potential of the photosensitive drum becomes non-uniform when the photosensitive drum surface is exposed to a laser beam by the image exposure device next time. More specifically, if the image pattern with a strong contrast is first formed and subsequently a half-tone image is formed, the preceding image pattern may appear in the half tone image, namely a "ghost image" is formed.

In order to prevent formation of the ghost image, the photosensitive drum is uniformly irradiated (i.e., whole surface exposure) by a pre-charge exposure device having a light source such as a LED to make the surface potential of the photosensitive drum uniform which was exposed by the image exposure device in the previous image forming. In other words, a light portion potential corresponding to a potential of an area which is exposed in the previous image forming and a dark portion potential corresponding to a potential of an area which is not exposed in the previous image forming are equalized. In this way, the photosensitive drum surface can be uniformly charged the next time and the formation of the ghost image can be prevented. For preventing the formation of the ghost image, it is effective to use the pre-charge exposure device which is capable of emitting a large quantity of light.

However, if the photosensitive drum is uniformly irradiated by the pre-charge exposure device and the surface potential of the photosensitive drum becomes completely uniform, a problem of scatter of the residual transfer toner arises. The residual transfer toner is the toner remaining on the photosensitive drum which is not transferred to the transfer material during a transfer process. The residual toner may scatter in an image forming apparatus which performs pre-charge exposure before a cleaning process. The toner image is formed on the electrostatic latent image which is formed on the photosensitive drum surface by the image exposure device. The residual transfer toner on the photosensitive drum which is not transferred to the transfer material during the transfer process is also left on the electrostatic latent image. If the potential of the electrostatic latent image is completely and entirely uniformed by the pre-charge exposure device, an adhesive force between the toner and the photosensitive drum will be reduced. Accordingly, the residual transfer toner will no longer stay on the surface of the photosensitive drum. As a result, the toner scattering occurs. From a viewpoint of preventing the toner scattering, a small quantity of light is effective with respect to the light emitted from the pre-charge exposure device.

Further, decrease in the light quantity of the pre-charge exposure device when the pre-charge exposure device is used for a long time is discussed in Japanese Patent Application Laid-Open No. 11-174755. If the light quantity of the pre-charge exposure device decreases, a vestige of the previously-formed image may not be successfully deleted and may result in the formation of ghost image.

Thus, in order to reduce the formation of ghost image and prevent the toner scattering at the same time, it is necessary to optimize the light quantity emitted from the pre-charge exposure device depending on variations in manufacturing and the change caused through device usage with respect to the pre-charge exposure device such as a LED, a photosensitive drum film thickness, and photosensitive drum sensitivity.

Conventionally, the light quantity of the pre-charge exposure device has been controlled according to a relation between the surface potential of the photosensitive drum detected by a surface potential detection device and a current applied to the charging device as discussed in Japanese Patent Application Laid-Open No. 11-174755. Since the surface potential detection device of the photosensitive drum can directly measure the surface potential of the photosensitive drum, the light quantity of the pre-charge exposure device can be controlled to obtain a desired surface potential of the photosensitive drum surface.

Further, Japanese Patent Application Laid-Open No. 2004-334063 discusses a technique for estimating the photosensitive drum film thickness (film thickness of photosensitive layer) by applying a detection bias to a charging member and measuring a current that flows through the charging member. Thus, the light quantity of the pre-charge exposure device can be changed according to the film thickness of the photosensitive drum. According to the technique, if the film thickness of the photosensitive drum is thick, the pre-charge exposure device adjusts the light quantity to a small value. When the film thickness of the photosensitive drum becomes thinner along with the use of the image forming apparatus, the light quantity is increased.

However, since the surface potential detection device is expensive, employment of the surface potential detection device is not desirable from the viewpoint of providing an inexpensive image forming apparatus.

Applying detection bias to the charging member to estimate the photosensitive drum film thickness from the current that flowed through the charging member, and adjusting the light quantity of the pre-charge exposure device according to the film thickness is effective to a certain extent with respect to variation in photosensitive drum film thickness and photosensitive characteristics. However, it is difficult to estimate a change in the light quantity of the pre-charge exposure device occurring due to variations in manufacturing and the wear caused through the long time use, and adjust the light quantity of the pre-charge exposure device. Therefore, to deal with the variations in the manufacturing, more precise adjustment of the light quantity of the pre-charge exposure device has been required before shipment. However, when the light quantity is precisely adjusted, manufacturing efficiency will be lowered which will result in increased cost. Further, if the light quantity of the pre-charge exposure device is reduced due to the long time use or stain on the pre-charge exposure device caused by a user, the ghost image is formed on the drum. Furthermore, individual variation of the contact charging member or variation in resistance value according to a use environment may cause a difference in charge current value which leads to insufficient detection accuracy.

SUMMARY OF THE INVENTION

According to an aspect of the present invention, an image forming apparatus is capable of determining optimum light quantity of a pre-charge exposure device in an image-forming period as needed without using a surface potential detection device.

According to another aspect of the present invention, an image forming apparatus is capable of reducing toner scattering while preventing formation of a ghost image and keeping appropriate image quality regardless of variation and status of use of an electrophotographic photosensitive member, a contact charging member, and a pre-charge exposure device.

According to another aspect of the present invention, an image forming apparatus includes a rotatable electrophotographic rotatable electrophotographic photosensitive member, a contact charging member configured to charge a surface of the rotatable electrophotographic photosensitive member by contacting the rotatable electrophotographic photosensitive member, a charging current detection device configured to detect a current value that flows through the contact charging member, a pre-charge exposure device configured to remove a residual charge by exposing the surface of the rotatable electrophotographic photosensitive member to light before the rotatable electrophotographic photosensitive member is charged by the contact charging member, a standard exposure device adjusted to emit light of a predetermined light quantity and configured to expose the surface of the rotatable electrophotographic photosensitive member to the light, and a control device configured to control, in a non-image-forming period, the charging current detection device to detect a first current value which flows through the contact charging member when an area on the surface of the rotatable electrophotographic photosensitive member is recharged by the contact charging member, in a case where the rotatable electrophotographic photosensitive member which is charged by applying a predetermined voltage by the contact charging member is exposed by turning on the standard exposure device without turning on the pre-charge exposure device, to control, in the non-image-forming period, the charging current detection device to detect a second current value which flows through the contact charging member when an area on the surface of the rotatable electrophotographic photosensitive member is recharged by the contact charging member, in a case where the rotatable electrophotographic photosensitive member which is charged by applying a predetermined voltage by the contact charging member is exposed by turning on the pre-charge exposure device without turning on the standard exposure device, and to determine light quantity of the pre-charge exposure device based on the first current value and the second current value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 is verification data illustrating a state in which a ghost image is generated and a state in which toner is scattered.

DETAILED DESCRIPTION OF THE EMBODIMENTS

Various exemplary embodiments, features, and aspects of the invention will be described in detail below with reference to the drawings.

Figure 1:
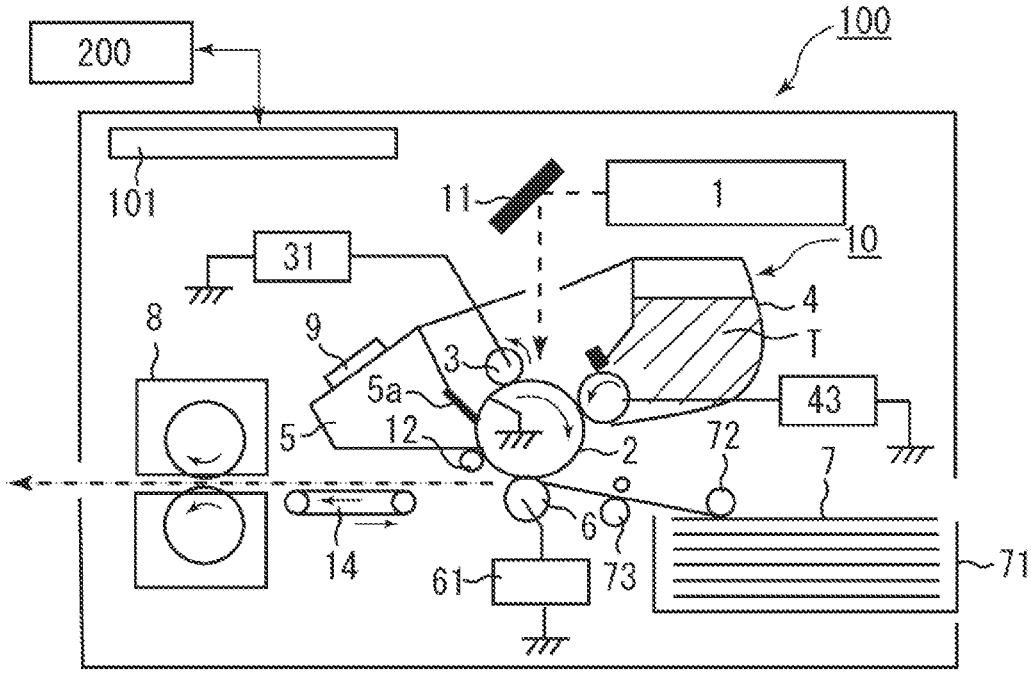
FIG. 1 illustrates a configuration of an image forming apparatus according to a first exemplary embodiment of the present invention.

FIG. 1 illustrates a configuration of an image forming apparatus according to a first exemplary embodiment of the present invention.

The image forming apparatus according to the present exemplary embodiment is an electrophotographic printer configured to perform a series of image forming processes including charging, exposing, developing, transferring, and cleaning with respect to a rotatable electrophotographic photosensitive member to form an image on a transfer material.

An image is formed on a transfer material (recording medium). The image corresponds to an electric image signal input from an external host apparatus 200, such as a personal computer, to a control device (engine controller) 101 of an image forming apparatus 100. The control device 101 exchanges various information with the external host apparatus 200 and makes overall control of operations of the image forming apparatus 100 based on a predetermined control program or a reference table. The transfer material is, for example, recording paper, overhead projector (OHP) sheet, or fabric. Further, the transfer material can be an intermediate transfer member such as an intermediate transfer drum or an intermediate transfer belt.

Process devices that execute the above-described series of image forming processes include a contact charging member 3 configured to charge a rotatable drum-shaped electrophotographic photosensitive member (hereinafter referred to as a photosensitive drum) 2, an image exposure device 1 configured to expose a surface of the photosensitive member of the charged photosensitive drum 2 to form an electrostatic latent image, a development device 4 configured to develop the electrostatic latent image with the developer to form a developed visible image (toner image), a transfer device 6 configured to transfer the toner image onto the transfer material, and a cleaning device 5 configured to clean the photosensitive drum 2 after the toner image is transferred onto the transfer material.

Figure 2:
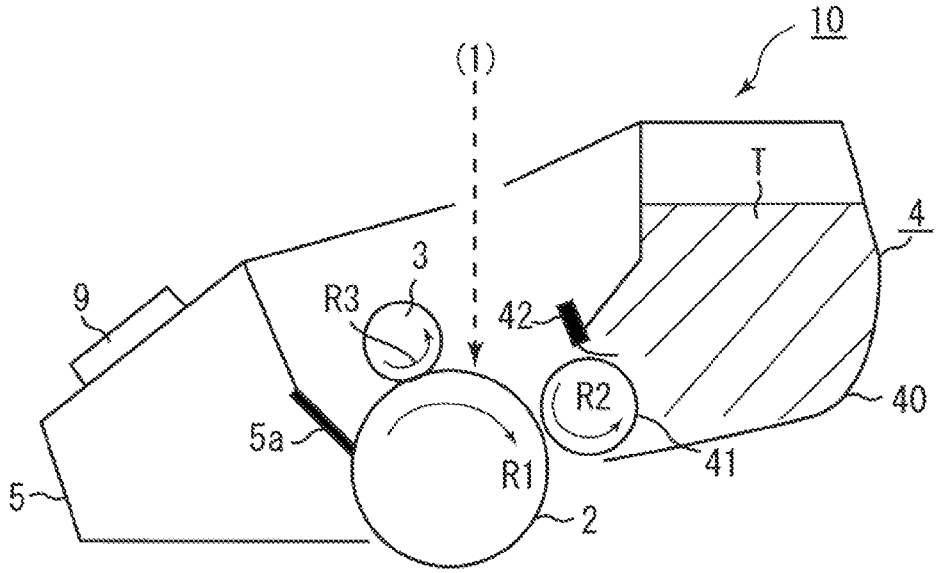
FIG. 2 is an enlarged view of a process cartridge portion of the image forming apparatus illustrated in FIG. 1.

At least a part of members that constitute the process devices can be configured as a process cartridge 10 which is detachably attached to a main body of the image forming apparatus. In the process cartridge 10 according to the present embodiment, the photosensitive drum 2, the contact charging member 3, the development device 4, and the cleaning device 5 are unitized. FIG. 2 is an enlarged view of the process cartridge 10 illustrated in FIG. 1. Components of the process cartridge 10 are assembled in the cartridge according to a predetermined arrangement. The process cartridge 10 is inserted into a predetermined portion of the main body of the image forming apparatus in a predetermined manner, but is also removable from the main body of the apparatus. Further, the process cartridge 10 includes a storage unit 9 configured to store various information about the process cartridge 10. The control device 101 exchanges various information with the storage unit 9. The photosensitive drum 2 rotates in a clockwise direction indicated by an arrow R1 at a predetermined peripheral speed (process speed).

The contact charging member 3 is configured to contact and charge the surface of the photosensitive drum 2. According to the present exemplary embodiment, the contact charging member 3 is a conductive roller arranged to abut on the photosensitive drum 2. Following the rotation of the photosensitive drum 2, the contact charging member 3 rotates in a counter clockwise direction indicated by an arrow R3. Since a predetermined charge voltage (DC voltage) is applied to the contact charging member 3 from a power supply unit 31, the surface of the photosensitive drum 2 which is rotating is uniformly charged to have a predetermined polarity and potential (dark portion potential).

The image exposure device 1 according to the present exemplary embodiment is a laser scanner including a laser device, a polygonal mirror, and a lens system. A laser beam which is modulated according to an image signal is emitted from the image exposure device 1 for scanning and reflected by a mirror 11 to irradiate the photosensitive drum 2. With this laser beam, the surface of the photosensitive drum 2 which is uniformly charged by the contact charging member 3 is scanned and exposed. Accordingly, surface potential of an exposed area on the surface of the photosensitive drum 2 decays to light portion potential. An electrostatic contrast between the dark portion potential and the light portion potential forms an electrostatic latent image which corresponds to an image exposure pattern on the surface of the photosensitive drum 2.

The development device 4 includes a developer container 40 configured to contain developer T, a developer bearing member 41 configured to bear and convey the developer T, and a developer layer thickness regulating member 42 configured to regulate a thickness of the developer on the developer bearing member 41. According to the present exemplary embodiment, magnetic one-component toner is used as the developer T. The developer bearing member 41 is arranged to face the photosensitive drum 2 in a non-contact manner with a predetermined gap in between. When the photosensitive drum 2 rotates in the direction of the arrow R1, the developer bearing member 41 rotates in a counter clockwise direction indicated by an arrow R2 with a predetermined peripheral speed ratio. The developer T is conveyed by the rotation of the developer bearing member 41, regulated to have a desired film thickness by the developer layer thickness regulating member 42, and conveyed to a development position which faces the photosensitive drum 2. A predetermined development voltage is applied to the developer bearing member 41 from a power supply unit 43. In this way, the electrostatic latent image formed on the surface of the photosensitive drum 2 becomes a visible toner image by reverse development or regular development.

On the other hand, a sheet of a transfer material 7 contained in a paper feed cassette 71 is separated and fed by a feeding roller 72 and conveyed to a registration roller 73 in synchronization with the formation of the latent image at the photosensitive drum 2. Then, the transfer material 7 is conveyed to the transfer device 6 including a transfer roller by the registration roller 73 in synchronization with a leading edge of the toner image formed on the photosensitive drum 2, and further conveyed to a transfer nip portion where the transfer device 6 abuts the photosensitive drum 2. Then the transfer material 7 is pinched and conveyed by the transfer nip portion. While the transfer material 7 is pinched and conveyed by the transfer nip portion, a predetermined transfer voltage (reverse polarity to toner charge polarity and with a predetermined potential) is applied to the transfer device 6 by a power supply unit 61. In this way, the toner image formed on the surface of the photosensitive drum 2 is transferred electrostatically in order onto the surface of the transfer material 7.

The transfer material 7 that passed the transfer nip portion is separated from the surface of the photosensitive drum 2 and conveyed to a fixing device 8 by a conveyance device 14. The fixing device 8 is a heat roller type fixing device, for example. While the transfer material 7 is pinched and conveyed by a fixing nip portion, the toner image is fixed onto the transfer material 7 by heat and pressure. Then the transfer material 7 with the fixed image is discharged from the image forming apparatus.

Further, the residual transfer toner remaining on the photosensitive drum 2 after the separation of the transfer material 7 is removed by the cleaning device 5 with a cleaning blade 5*a* made of an elastic blade. Then, the photosensitive drum 2 with its surface cleaned by the cleaning device 5 is used again for image forming.

A pre-charge exposure device 12 including a LED or a halogen lamp is arranged downstream of the transfer device 6 in the rotation direction of the photosensitive drum 2 but upstream of the cleaning device 5 in the rotation direction of the photosensitive drum 2 (i.e., before the cleaning process is performed). The pre-charge exposure device 12 performs whole surface exposure on the surface of the photosensitive drum 2 to remove a residual charge (electrical memory) before the surface of the photosensitive drum 2 is charged by the contact charging member 3 so that non-uniform potential on the surface of the photosensitive drum 2 due to the preceding image forming is uniformed.

Figure 3:
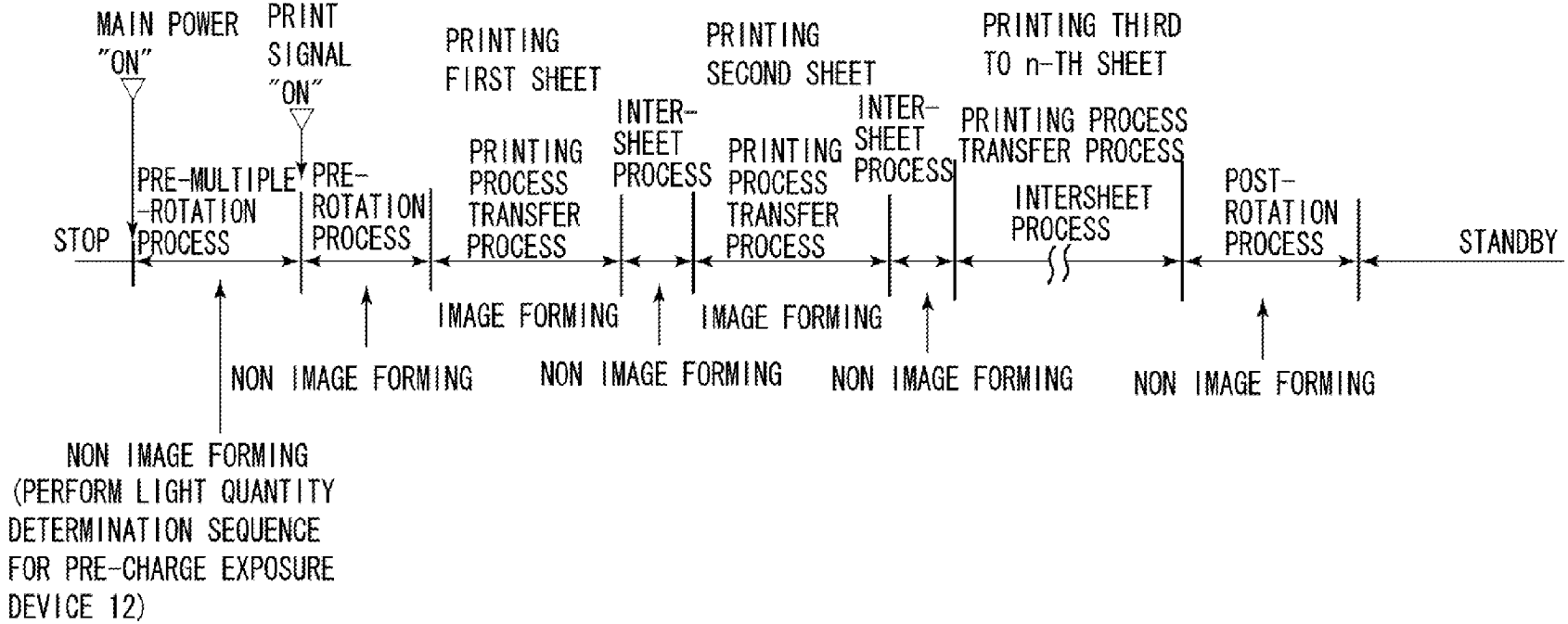
FIG. 3 is an operation sequence diagram of the image forming apparatus.

FIG. 3 is an operation sequence diagram of the above-described image forming apparatus.

a. Pre-multiple-rotation process: A starting operation period (i.e., start-up period and warm-up period) of the image forming apparatus. The main power supply switch is turned on to start a main motor (not shown) of the apparatus and rotate the photosensitive drum 2 to make predetermined process devices ready for operation.

b. Pre-rotation process: A pre-printing operation period. This process follows the pre-multiple-rotation process if a print signal is input during the pre-multiple-rotation process. If no print signal is input, the main motor is stopped after the pre-multiple-rotation process is completed. Accordingly, the rotation of the photosensitive drum 2 also stops and the image forming apparatus is made to wait in a standby state until the print signal is input. When the print signal is input, the main motor is started again and the photosensitive drum 2 is rotated to perform the pre-rotation process.

c. Printing process (image forming process and imaging process): After the predetermined pre-rotation process is completed, an image is formed on the photosensitive drum 2 which is rotating. The toner image formed on the surface of the photosensitive drum 2 is transferred onto the transfer material and fixed by the fixing device, and an image-formed product is printed out. If the image forming apparatus is in a continuous printing mode, the above-described printing process is repeated a number of times corresponding to a number of sheets to be printed.

d. Intersheet process: A period between the time when a trailing edge of the transfer material passes the transfer nip portion in the continuous printing mode to the time when a leading edge of a following transfer material reaches the transfer nip portion. No transfer material passes the transfer nip portion during this period.

e. Post-rotation process: After the printing process of the last transfer material is completed, the main motor is kept running for some time to continue rotation of the photosensitive drum 2 and perform predetermined post operations.

f. Standby: After the predetermined post-rotation operations are completed, the main motor is stopped to stop the rotation of the photosensitive drum 2. The image forming apparatus is made to wait in the standby state until the next print start signal is input.

In a case where only one sheet of transfer material is printed, when the printing of the sheet is completed, the image forming apparatus enters the standby state after the post-rotation process is completed. The image forming apparatus shifts to the pre-rotation process if a print start signal is input in the standby state.

The printing process (c) corresponds to an image-forming period. On the other hand, the pre-multiple-rotation process (a), the pre-rotation process (b), the intersheet process (d), and the post-rotation process (e) correspond to a non-image-forming (non-imaging) period. The image-forming period of the pre-charge exposure device 12 is a period in which pre-exposure is performed on an area of the photosensitive drum 2 where a toner image is to be formed. In contrast, the image-forming period of the image exposure device 1 (standard exposure apparatus) is a period in which image exposure is performed on the area of the photosensitive drum 2 where the toner image is to be formed.

Figure 4:
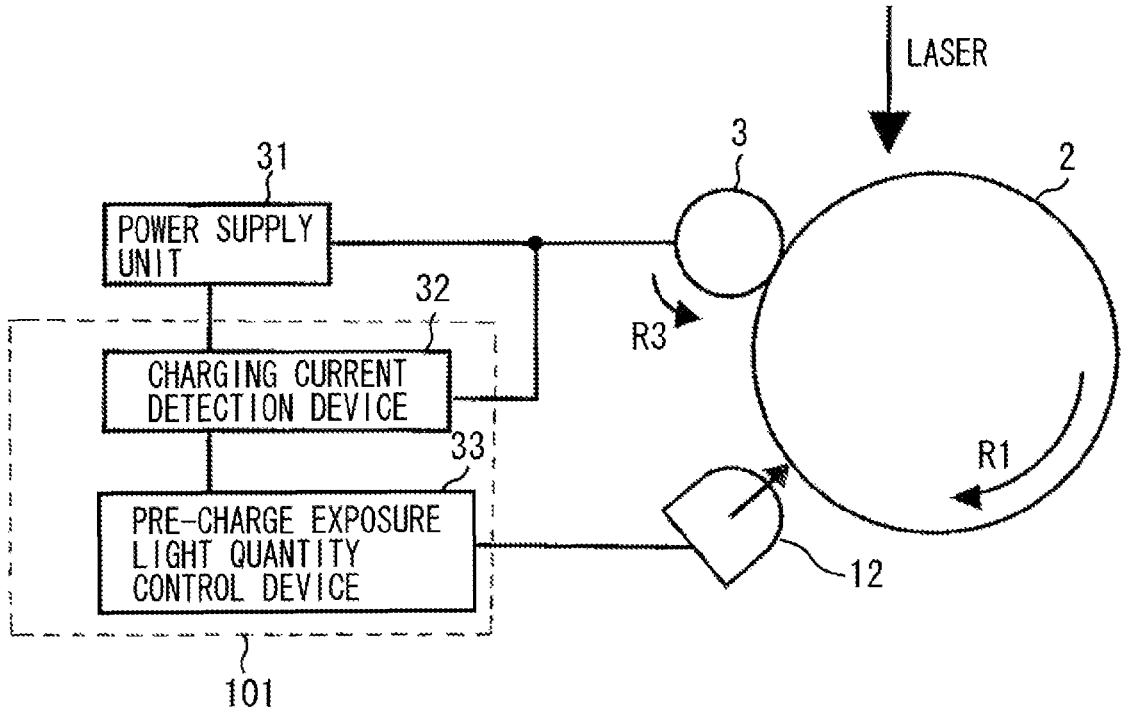
FIG. 4 is a block diagram of a control system of a pre-charge exposure device.

FIG. 4 illustrates a block diagram of a control system of the pre-charge exposure device 12.

As described above, the contact charging member 3 is arranged to abut the photosensitive drum 2. Light beams from at least two types of light sources are directed on the photosensitive drum 2. One is a light beam emitted from the image exposure device 1 for forming the electrostatic latent image. Its light source is, for example, a laser. The other is a light beam emitted from the pre-charge exposure device 12. Its light source is, for example, LED. According to the present exemplary embodiment, a laser exposure apparatus is used as the image exposure device 1 and a LED exposure apparatus is used as the pre-charge exposure device 12. The image exposure device 1 includes an automatic power control (APC) function for controlling a light quantity. Thus, a desired light quantity can be output with stability for a long time.

Further, the power supply unit 31 is connected to the contact charging member 3. The power supply unit 31 applies a DC voltage to the contact charging member 3 as a charging voltage. The control device 101 includes a charging current detection device 32 configured to detect a current that flows through the contact charging member 3. In addition, the control device 101 includes a pre-charge exposure light quantity control device 33 configured to control output of the pre-charge exposure device 12 based on a detection result obtained by the charging current detection device 32. Accordingly, the control device 101 controls the quantity of light emitted from the pre-charge exposure device 12.

According to the present exemplary embodiment, the pre-charge exposure light quantity control device 33 controls the light quantity by changing the current (voltage) fed to the pre-charge exposure device 12. However, a different method can be used for changing the light quantity of the pre-charge exposure device 12. For example, the light quantity may be controlled by pulse width modulation (PWM) control.

As the light source of the pre-charge exposure device 12, a LED and a halogen lamp, for example, can be used. Although the type of the light source is not limited, the LED is desirable from the viewpoint of low driving voltage and ease of downsizing of the apparatus. For these reasons, a LED is used as the light source of the pre-charge exposure device 12 in the present exemplary embodiment. The light quantity of the pre-charge exposure device 12 is set at a level that can prevent a ghost image as well as toner scattering.

Formation of the ghost image will now be described. The surface of the photosensitive drum 2 after an image is formed has non-uniform potential according to the image that has been formed. If the next charging is performed in this state, uniform charging may not be performed due to the previous image that has been formed. Thus, when the photosensitive drum 2 is exposed to light the next time by the image exposure device 1, the surface of the photosensitive drum 2 may have non-uniform potential. This causes the ghost image. Thus, it is necessary to make the potential uniform on the surface of the photosensitive drum 2 by the pre-charge exposure device 12 before the surface of the photosensitive drum 2 is charged.

The ghost image tends to be generated when the previous image formed on the photosensitive drum has a strong contrast. Thus, in preventing the ghost image, it is important to reduce the difference between the light portion potential and the dark portion potential by the pre-charge exposure device 12 by the next time the photosensitive drum 2 is charged. The light portion potential and the dark portion potential are the potential on the surface of the photosensitive drum 2 when the photosensitive drum 2 is exposed to the light by the image exposure device 1 which is used for forming an electrostatic latent image.

In other words, in a system including the pre-charge exposure device 12, a relation between the light portion potential on the surface of the photosensitive drum 2 which has been exposed to the light by the image exposure device 1 and the light portion potential on the surface of the photosensitive drum 2 on which the whole surface exposure is performed by the pre-charge exposure device 12 becomes an important parameter in the formation of the ghost image.

Next, occurrence of the toner scattering will be described. If the photosensitive drum surface is entirely exposed to a large quantity of exposure light by the pre-charge exposure device 12 and the potential on the photosensitive drum surface becomes completely uniform, then the residual transfer toner which was not transferred in the transfer process will be scattered. This may occur in an image forming apparatus such as the one described in the present exemplary embodiment, where pre-charge exposure is performed before the cleaning process. The toner image formed on the photosensitive drum 2 is formed on the electrostatic latent image formed by the image exposure device 1. The residual transfer toner which was not transferred onto the transfer material 7 in the transfer process also remains on the electrostatic latent image on the photosensitive drum 2. If the potential of the electrostatic latent image is completely and entirely uniformed by the pre-charge exposure device 12, adhesive force between the toner and the photosensitive drum 2 will be reduced. Then, the residual transfer toner on the electrostatic latent image will no longer stay on the surface of the photosensitive drum 2. As a result, the toner scattering occurs. Thus, in preventing the toner scattering, it is important not to make the difference between the light portion potential and the dark portion potential too small by the pre-charge exposure device 12. The light portion potential is the potential on the surface of the photosensitive drum 2 when the photosensitive drum 2 is exposed to the light emitted from the image exposure device 1 which is used for forming the electrostatic image, and the dark portion potential is the potential on the surface of the photosensitive drum 2 when the photosensitive drum 2 is not exposed to the light.

In other words, in the image forming apparatus having the pre-charge exposure device 12 arranged in a space between the transfer device and the cleaning device, the above-described difference in potential will also be an important parameter in the occurrence of the toner scattering. More specifically, the relation between the light portion potential on the surface of the photosensitive drum 2 which has been exposed to the light by the image exposure device 1 and the light portion potential on the surface of the photosensitive drum 2 on which the whole surface exposure is performed by the pre-charge exposure device 12 will be an important parameter in the occurrence of the toner scattering.

Next, detection of a charging current will be described. First, the DC voltage is applied to the contact charging member 3. While the contact charging member 3 charges the photosensitive drum 2 so that its surface has a predetermined charge potential (dark portion potential), only the pre-charge exposure device 12 emits (i.e., turned on) the light to the photosensitive drum with a different light quantity. At this time, the image exposure device 1 does not emit (i.e., turned on) the light. Then, the charging current detection device 32 detects a charging current value when an area of the photosensitive drum 2 which has been exposed to the light is recharged by the contact charging member 3.

Figure 5:
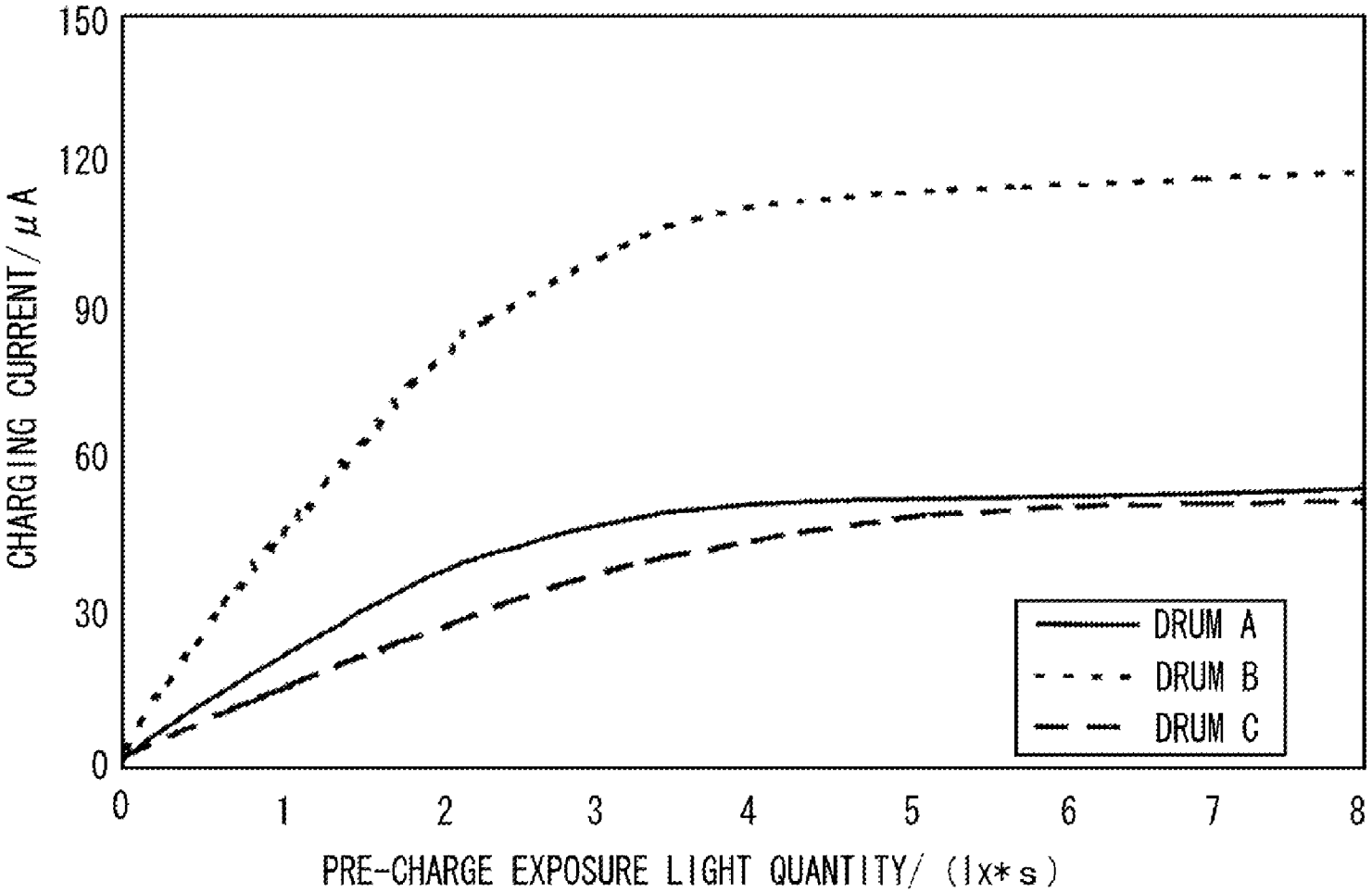
FIG. 5 illustrates a relation between a light quantity and a charging current of the pre-charge exposure device.

FIG. 5 illustrates a relation between the light quantity (1x·s) of the pre-charge exposure device 12 and charging current value Ic (μA). In FIG. 5, the surface of the photosensitive drum 2 (dark portion potential) is charged at a potential of −600 V by the contact charging member 3.

Three types of photosensitive drum 2 (photosensitive drums A, B, and C) are illustrated in FIG. 5. The photosensitive drums A and B have approximately equal sensitivity, however the film thickness (film thickness of the photosensitive layer) of the photosensitive drum A is thicker than that of the photosensitive drum B. The photosensitive drums A and C have approximately equal thickness, however the sensitivity of the photosensitive drum A is higher than that of the photosensitive drum C.

A charging current value Ic is fed to the contact charging member 3 when the photosensitive drum 2 whose potential is reduced from the dark portion potential to the light portion potential by exposure is recharged to the dark portion potential by next charging. If the exposure is performed with a large light quantity and a variation from the dark portion potential to the light portion potential is great, when the light portion potential is charged to the dark portion potential by the contact charging member 3 in the next time, a discharged amount will be increased and a large charging current will be fed from the contact charging member 3.

Thus, the charging current value Ic has a positive correlation with a variation amount in potential from the dark portion potential to the light portion potential when the photosensitive drum 2 is exposed to the light. In other words, the charging current value Ic has a positive correlation with the light portion potential on the surface of the photosensitive drum 2. Further, if photosensitive drums having approximately equal sensitivity but having different film thickness are compared, a photosensitive drum having thinner film thickness will have a larger charging current value Ic when the surface of the photosensitive drum is recharged by the contact charging member 3 even if the variation from the dark portion potential to the light portion potential is equal. This is because charging capability of the photosensitive drums depends on the film thickness. Further, if photosensitive drums having approximately equal film thickness but having different sensitivity are compared, the charging current value Ic that flows when the surface of the photosensitive drums are recharged by the contact charging member 3 will be approximately equal if the variation from the dark portion potential to the light portion potential is equal.

A similar experiment was performed in the image exposure device 1 used for forming an electrostatic latent image instead of the pre-charge exposure device 12. The surface of the photosensitive drum was exposed to light in a predetermined light quantity by whole surface exposure. In this case also, a charging current value Ico which corresponds to the light portion potential on the surface of the photosensitive drum was fed to the photosensitive drum. At this time, the pre-charge exposure device 12 was not turned on.

From the results of the above-described experiments, a strong correlation is seen between the light portion potential of the photosensitive drum surface and the charging current value for recharging the photosensitive drum 2 when the surface of the photosensitive drum 2 is exposed to the light by whole surface exposure by the image exposure device 1 while the surface of the photosensitive drum 2 is charged uniformly by applying the DC voltage to the contact charging member 3.

As described above, the relation between the light portion potential on the surface of the photosensitive drum 2 on which the whole surface exposure is performed by the image exposure device 1 and the light portion potential on the surface of the photosensitive drum 2 on which the whole surface exposure is performed by the pre-charge exposure device 12 will be an important parameter for both of the formation of the ghost image and the occurrence of the toner scattering.

According to the present exemplary embodiment, the image exposure device 1 is used as a standard exposure apparatus (i.e., an exposure apparatus adjusted to a predetermined light quantity). The charging current value Ico which is detected while the whole surface exposure is performed on the surface of the photosensitive drum 2 with the light of the predetermined light quantity by the image exposure device 1 alone is determined as a standard value of the charging current. If the above-described charging current detection is adopted, only a relation between the above-described charging current value Ico (first current value) and the charging current value Ic (second current value) which is detected while the whole surface exposure of the photosensitive drum 2 is performed by the exposure device 12 alone needs to be considered.

Thus, focusing on a parameter Ic/Ico, the light quantity of the pre-charge exposure device 12 can be controlled for Ic/Ico to have a desired value. Although the simple parameter Ic/Ico is used in the present exemplary embodiment, a different parameter can be used so long as it includes a relation between the charging current values Ic and Ico. For example, the parameter may be a relational expression of a difference between the charging current value Ico and the charging current value Ic.

Further, the charging current value Ic which is detected while the whole surface exposure of the photosensitive drum 2 is performed by the pre-charge exposure device 12 alone varies according to the film thickness of the photosensitive drum 2 as described above. Furthermore, since resistance of the contact charging member 3 varies according to its individual variation, status of use, and use environment, the charging current value Ic is affected by the resistance. Thus, it is not optimal to control the light quantity of the pre-charge exposure device 12 merely such that the charging current value Ic has a specified value.

Therefore, the light quantity of the pre-charge exposure device 12 is controlled for Ic/Ico to have the desired value based on the charging current value Ico which is detected when the whole surface exposure of the photosensitive drum 2 is performed by the image exposure device 1 which is capable of emitting a stable light quantity.

In other words, the standard exposure apparatus having the light quantity adjusted to the predetermined light quantity is used in the present exemplary embodiment. According to the present exemplary embodiment, the image exposure device 1 is also used as the standard exposure device. In the non-image-forming period, the photosensitive drum 2 which is charged by the contact charging member 3 by applying a predetermined DC voltage is exposed to the light emitted from the standard exposure device 1 while the pre-charge exposure device 12 is turned off. Next, an area on the surface of the photosensitive drum 2 which has been exposed by the standard exposure device 1 is recharged by the contact charging member 3. Then, the charging current detection device 32 detects a current that is fed by the contact charging member 3. The obtained current value is determined as a first charging current value. Further, in the non-image-forming period, the photosensitive drum 2 which is charged by the contact charging member 3 applying the predetermined DC voltage is exposed to the light emitted from the pre-charge exposure device 12 while the standard exposure device 1 is turned off. Next, an area on the surface of the photosensitive drum 2 which has been exposed by the pre-charge exposure device 12 is recharged by the contact charging member 3. Then, the charging current detection device 32 detects the current that is fed by the contact charging member 3. The obtained current value is determined as a second charging current value. The control device 101 includes a control mode for determining the light quantity of the pre-charge exposure device 12 in the image-forming period from the above-described relation between the first and the second charging current values.

According to the above-described control mode, the light quantity of the pre-charge exposure device 12 can be controlled to an optimum value regardless of the status of use and variations in manufacturing of the photosensitive drum 2 as well as the status of use and variations in manufacturing of the contact charging member 3. Further, since output of the pre-charge exposure device 12 can be controlled so that the desired Ic/Ico is obtained even if the light quantity of the pre-charge exposure device 12 varies due to the variations in manufacturing, the light quantity of the pre-charge exposure device 12 can be optimally adjusted.

Further, the present exemplary embodiment can handle a case where the light quantity of the pre-charge exposure device 12 is reduced by long-time use or by stain caused by a user. More specifically, the output of the pre-charge exposure device 12 can be increased so that Ic/Ico is to be the desired value based on the standard charging current value Ico detected by the image exposure device 1, which will allow the photosensitive drum 2 to be exposed to the light of desired light quantity. Since the image exposure device 1 includes the APC function, the image exposure device 1 is capable of controlling the light to have the desired light quantity for a long time. By determining the light quantity of the pre-charge exposure device 12 based on the image exposure device 1 which is capable of emitting the stable light quantity, the pre-charge exposure device 12 can emit the light in the desired light quantity.

Similar control is not achieved if the pre-charge exposure device 12 (or the charging current value Ic) alone is used. This is because the light quantity of the pre-charge exposure device 12 may vary depending on the status of use of the pre-charge exposure device 12. If the charging current value Ic varies, it is difficult to determine whether the change has been caused by the status of use of the photosensitive drum 2 or the charging member, or by the status of use of the pre-charge exposure device 12.

According to the present exemplary embodiment, optimum light quantity of the pre-charge exposure device 12 in the image-forming period can be determined without using the surface potential detection device. Therefore, a less expensive image forming apparatus can be provided.

Tables shown in FIG. 6 illustrate occurrence of the ghost image and the toner scattering when an image is formed under various Ic/Ico settings by changing the light quantity of the pre-charge exposure device 12 while the light quantity of the exposure device 1 is kept constant of 3.0 [$mJ \cdot m^{-2}$]. The surface of the photosensitive drum 2 (dark portion potential) is charged at a potential of −600 V by applying a predetermined DC voltage to the contact charging member 3.

Three types of photosensitive drum 2 (photosensitive drums A, B, and C) were prepared. The photosensitive drums A and B have approximately equal sensitivity, however the film thickness of the photosensitive drum A is thicker than that of the photosensitive drum B. The photosensitive drums A and C have approximately equal film thickness, however the sensitivity of the photosensitive drum A is higher than that of the photosensitive drum C.

With respect to the row of the ghost image, "YES" indicates that a ghost image was formed, "SLIGHT" indicates that a ghost image was slightly formed, and "NO" indicates that no ghost image was formed. With respect to the row of the toner scattering, "YES" indicates that toner was scattered, "SLIGHT" indicates that a small amount of toner was scattered, and "NO" indicates that toner was not scattered.

With respect to all of the photosensitive drums A, B, and C, the value of Ic/Ico when no ghost image was generated was as follows:

$$Ic/Ico \geqq 0.46$$

Further, with respect to all of the photosensitive drums A, B, and C, the value of Ic/Ico when no toner scattering occurred was as follows:

$$Ic/Ico \leqq 0.58$$

Thus, in order to prevent the toner scattering without forming the ghost image, the light quantity of the pre-charge exposure device 12 is controlled to be $0.46 \leqq Ic/Ico \leqq 0.58$.

Next, the light quantity control of the pre-charge exposure device 12 will be described. According to the present exemplary embodiment, the control device 101 executes a sequence for determining the light quantity E(n) of the pre-charge exposure device 12 in the image-forming period, during the pre-multiple rotation period (i.e., the non-image-forming period). The time to determine the light quantity E(n) of the pre-charge exposure device 12 in the image-forming period, however, is not limited to the pre-multiple rotation period. It can be determined in a different period so long as the determination is made in the non-image-forming period. For example, it can be determined during a pre-rotation period or post-rotation period.

First, a predetermined DC voltage is applied to the contact charging member 3 during the pre-multiple rotation period (i.e., the non-image-forming period). While the contact charging member 3 charges the surface of the photosensitive drum 2 to a predetermined charge potential (dark portion potential), the image exposure device 1 performs the whole surface exposure on the surface of the photosensitive drum 2. Then, the charging current detection device 32 detects the charging current value Ico when an exposed area of the photosensitive drum 2 is recharged by the contact charging member 3. At this time, it is most desirable if the light quantity of the exposure device 1 equals the light quantity in the image-forming period. The light quantity, however, can be different from the one in the image-forming period. Effective results can be obtained so long as the light quantity that satisfies Ico±25% is used with respect to the charging current value Ico when the photosensitive drum 2 is exposed to the light having equal light quantity used in the image-forming period.

Thus, the light quantity of the exposure device 1 as the standard exposure device used in obtaining the aforementioned first charging current value is equal to or within ±25% of the light quantity of the exposure device 1 when the exposure device 1 forms the electrostatic latent image in the image-forming period.

Next, after turning off the image exposure device 1, while the surface of the photosensitive drum 2 is charged to have a predetermined charge potential (dark portion potential), the pre-charge exposure device 12 performs the whole surface exposure a plurality of times on the surface of the photosensitive drum 2 by changing the light quantity from E(1) to E(n) in a stepwise fashion. Then, the charging current detection device 32 detects charging currents Ic(1) to Ic(n), when exposed area on the surface of the photosensitive drum 2 which has been exposed to the light having the light quantity of E(1) to E(n) is recharged by the contact charging member 3. After then, Ic(n)/Ico will be calculated.

If the calculated value satisfies $0.46 \leqq Ic(n)/Ico \leqq 0.58$, then the light quantity of the pre-charge exposure device 12 in the image-forming period will be determined as E(n).

According to the present exemplary embodiment, Ic(n)/Ico is set as $0.46 \leqq Ic(n)/Ico \leqq 0.58$, however, this value needs to be determined in advance depending on the image forming apparatus.

According to the present exemplary embodiment, the light quantity E(n) of the pre-charge exposure device 12 in the image-forming period, which is determined as described above, is set smaller than the light quantity of the exposure device 1 which is used in forming the electrostatic latent image on the surface of the photosensitive drum 2 in the image-forming period.

Then, the image forming apparatus turns off the pre-charge exposure device 12, turns off the DC voltage applied to the contact charging member 3, and waits in a standby state. If a print start signal is input when the image forming apparatus is in the standby state, then the image forming apparatus proceeds to the pre-rotation process. The pre-rotation process is started subsequent to the pre-multiple-rotation process if a print signal is input during the pre-multiple-rotation process.

Figure 7:
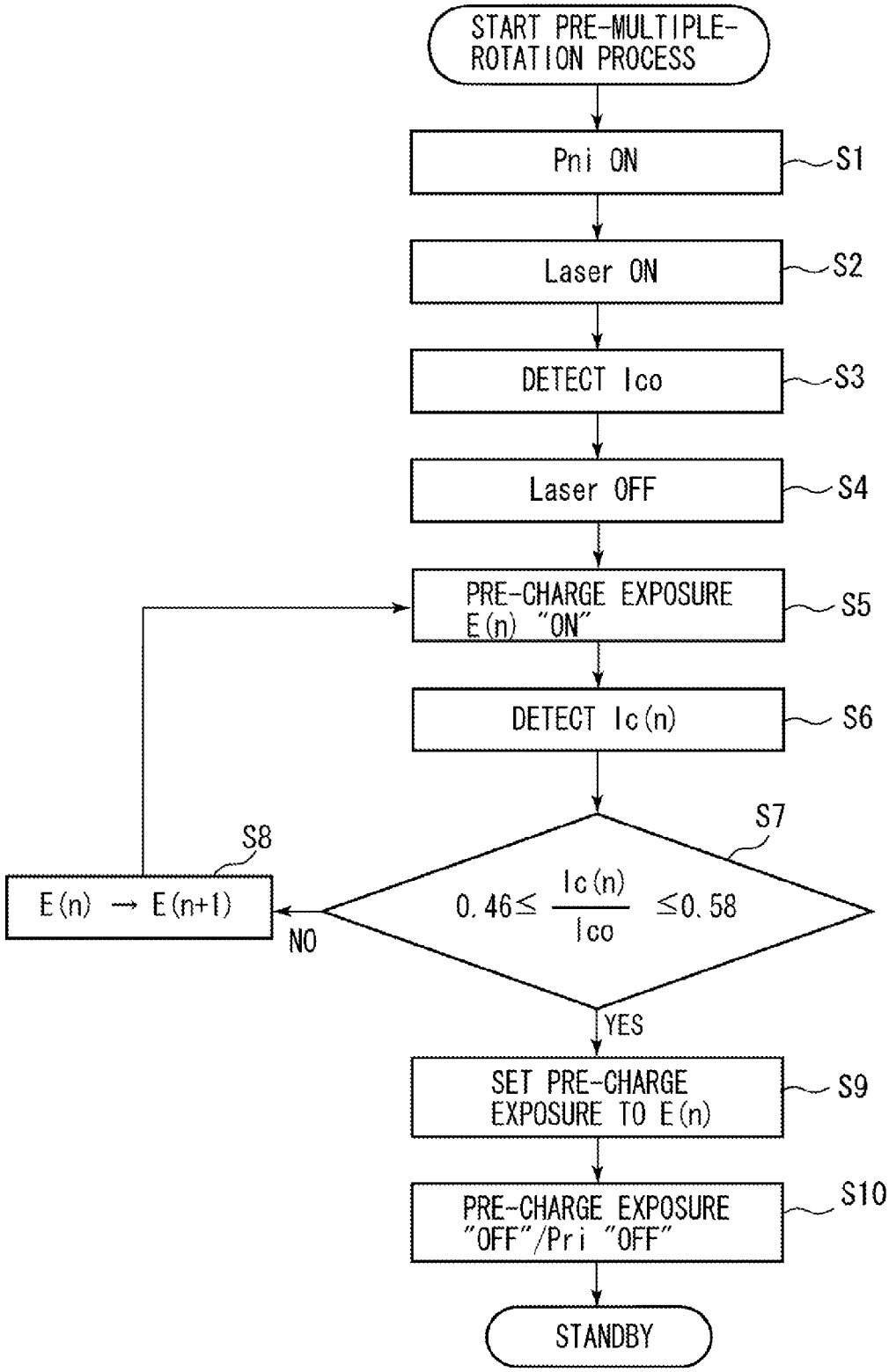
FIG. 7 is a flowchart illustrating light quantity control of the pre-charge exposure device.

The above-described pre-charge exposure device 12 is controlled by the control device 101 based on a predetermined control program or a reference table. FIG. 7 illustrates a control flowchart of the pre-charge exposure device 12.

In step S1, the control device 101 controls the power supply unit 31 to apply a predetermined DC voltage to the contact charging member 3 and charges the surface of the rotating photosensitive drum 2 to a predetermined charge potential (dark portion potential). In step S2, the control device 101 controls the image exposure device 1 to perform the whole surface exposure of the surface of the photosensitive drum 2. In step S3, the control device 101 controls the charging current detection device 32 to detect the charging current value Ico when the exposed area of the photosensitive drum 2 is recharged by the contact charging member 3. In step S4, the control device 101 turns off the image exposure device 1 to stop the exposure.

In step S5, the control device 101 controls the pre-charge exposure device 12 to perform whole surface exposure on the surface of the photosensitive drum 2 in the light quantity of E(n=1) while controlling the power supply unit 31 to continue applying the DC voltage to the contact charging member 3. In step S6, the control device 101 controls the charging current detection device 32 to detect the charging current value Ic(1) when the exposed area on the surface of the photosensitive drum 2 which has been exposed to the light in the light quantity E(n=1) by the pre-charge exposure device 12 is recharged by the contact charging member 3.

In step S7, the control device 101 controls the pre-charge exposure light quantity control device 33 to calculate Ic(n=1)/Ico and determines whether the calculated Ic(n=1)/Ico satisfies $0.46 \leqq Ic(n=1)/Ico \leqq 0.58$. If the control device 101 determines that the calculated Ic(n=1)/Ico does not satisfy $0.46 \leqq Ic(n=1)/Ico \leqq 0.58$ (NO in step S7), then the process proceeds to step S8. In step S8, the control device 101 changes the light quantity of the pre-charge exposure device 12 to E(n+1). Then, the process returns to step S5. The process is repeated until the condition in step S7 is satisfied. In step S7, if the control device 101 determines that the calculated Ic(n=1)/Ico satisfies 0.46≦Ic(n=1)/Ico≦0.58 (YES in step S7), then, the process proceeds to step S9.

In step S9, the control device 101 sets the pre-charge exposure light quantity in the image-forming period to E(n). In step S10, the control device 101 turns off the pre-charge exposure device 12 and the power supply unit 31. Then, the image forming apparatus 100 waits for a print job (print signal) in the standby state. When the image forming apparatus 100 receives a print job, the image forming process will be performed while the light quantity of the pre-charge exposure device 12 is set to E(n).

A relation between a control current input to the pre-charge exposure device 12 and the light quantity of the pre-charge exposure device 12 in an initial state of the image forming apparatus will be described using an image forming apparatus including the pre-charge exposure device 12 whose light quantity changes by 0.23 [1x·s] per input control current of 1.0 [mA]. A process cartridge including the above-described photosensitive drum A is mounted on the image forming apparatus.

The light quantity of the pre-charge exposure device 12 were changed from E(1) to E(n) in steps by increasing the control current input to the pre-charge exposure device 12 in steps.

When both of the image forming apparatus and the process cartridge were in the initial state, the control current input to the pre-charge exposure device 12 was 5.3 [mA] and the light quantity of the pre-charge exposure device 12 was 1.2 [1x·s].

After 10,000 sheets were image-formed using the image forming apparatus and the process cartridge, the control current input to the pre-charge exposure device 12 was 7.8 [mA] and the light quantity of the pre-charge exposure device 12 at that time was 1.6 [1x·s]. Further, the relation between the control current input in the pre-charge exposure device 12 and the light quantity of the pre-charge exposure device 12 was changed to the light quantity of 0.21 [1x·s] for the input control current of 1.0 [mA].

Since an optimum exposure light quantity of the pre-charge exposure device 12 depends on a number of sheets which is image-formed, such a number is counted by the control device 101.

A reason for change in the light quantity of the pre-charge exposure device 12 from 1.2 to 1.6 [1x·s] along with the use of the image forming apparatus is due to the change in photosensitivity characteristics of the photosensitive drum A along with its use. Further, change in the relation between the control current input to the pre-charge exposure device 12 and the light quantity of the pre-charge exposure device 12 is due to, for example, stain on the light source of the pre-charge exposure device 12 or decrease in the light quantity of the light source of the pre-charge exposure device 12 in long time use.

The image forming apparatus using a control sequence according to the present exemplary embodiment has been capable of appropriately controlling the light quantity of the pre-charge exposure device. However, if the pre-charge exposure device is controlled by a method which is not based on the above-described standard exposure device, even if the light quantity of the pre-charge exposure device is precisely adjusted before shipment, it is difficult to optimize the light quantity. This is because it is difficult to optimize the light quantity when the light source of the pre-charge exposure device is stained or when the light quantity of the light source of the pre-charge exposure device 12 is decreased.

As described above, a predetermined DC voltage is applied to the contact charging member 3 during the pre-multiple rotation period in the non-image-forming period. While the contact charging member 3 charges the surface of the photosensitive drum 2 to a predetermined charge potential (dark portion potential), the image exposure device 1 or the standard exposure device performs the whole surface exposure on the surface of the photosensitive drum 2. The charging current value detected at this time is the charging current value Ico which is the first current value. Further, the charging current values obtained by performing whole surface exposure on the surface of the photosensitive drum 2 by the pre-charge exposure device 12 while changing the light quantity of the pre-charge exposure device 12 from E(1) to E(n) in steps are determined as the charging current values Ic(1) through Ic(n) which are the second current values. From the above-described charging current value Ico and the charging current values Ic(1) through Ic(n), an optimum light quantity of the pre-charge exposure device 12 in the image-forming period can be determined regardless of variation and status of use of the photosensitive drum 2, the contact charging member 3, and the pre-charge exposure device 12. In this way, an image forming apparatus which is capable of preventing toner scattering and formation of a ghost image while keeping a favorable image quality can be provided.

Although the pre-charge exposure device is controlled so that the ratio of the charging current value Ico to the charging current value Ic is within a predetermined range according to the present exemplary embodiment, a different control method can be employed. For example, the pre-charge exposure device can be controlled by keeping a difference between the charging current values Ico and value Ic within a predetermined range.

Figure 8:
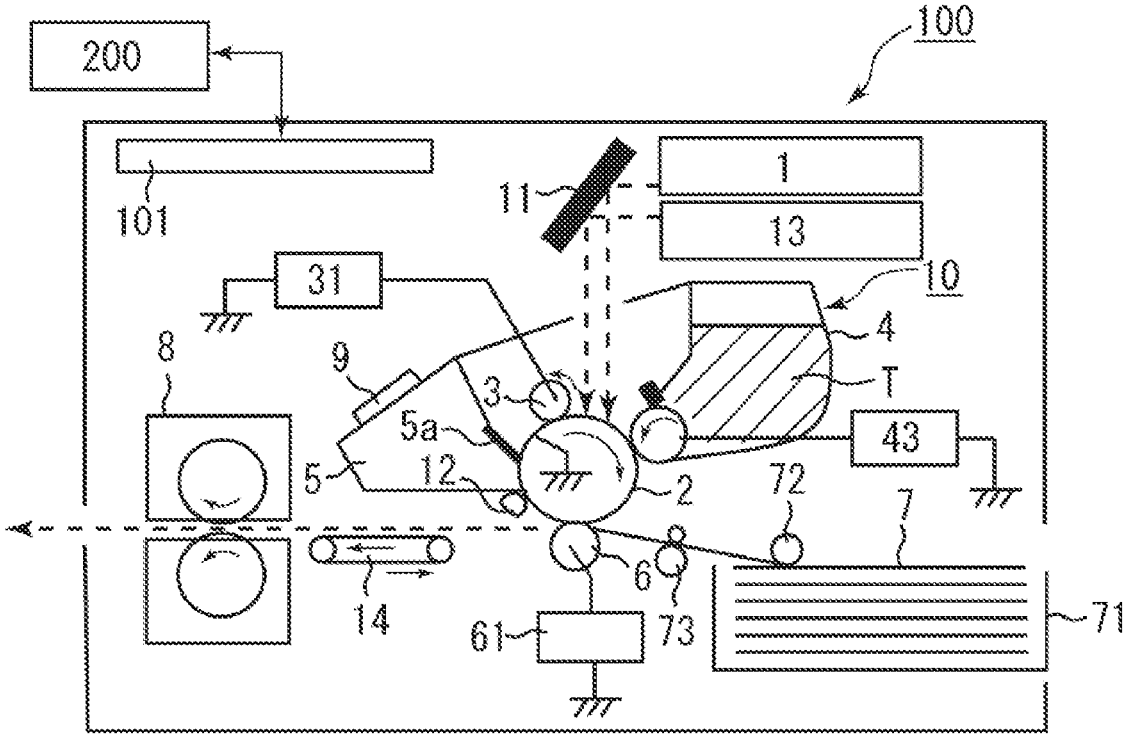
FIG. 8 illustrates a configuration of an image forming apparatus according to a second exemplary embodiment of the present invention.

A second exemplary embodiment of the present invention will now be described. According to the present exemplary embodiment, a dedicated standard light source 13 (standard exposure device) which is adjusted to emit a predetermined quantity of light is provided separately from the image exposure device 1 as illustrated in FIG. 8. According to the present exemplary embodiment, the standard light source 13 includes a laser device, a polygonal mirror, and a lens system, and employs a light source that emits a laser beam for scanning similar to the image exposure device 1 that forms an electrostatic latent image. The laser beam is reflected by a reflective mirror 11 and the surface of the photosensitive drum 2 is irradiated with the laser beam. Since the laser beam is controlled by APC, the laser beam in a desired light quantity can be stably emitted for a long time.

Although the standard light source 13 includes the light source that emits the laser beam according to the present exemplary embodiment, any light source may be used so long as it can stably output a desired quantity of light for a long time. Further, the standard light source 13 can be arranged in any position so long as it is capable of irradiating the photosensitive drum with the light. However, it is desirable to arrange the standard light source at a position which is inaccessible by the user and less likely to be stained.

According to the first exemplary embodiment, the image exposure device 1 configured to perform image exposure is also used as the standard exposure device. The image exposure device 1 emits the light to the surface of the photosensitive drum to perform the whole surface exposure. The charging current value detected when the contact charging member 3 recharges the exposed area on the surface of the photosensitive drum is determined as the first charging current value Ico. According to the present exemplary embodiment, the standard light source 13 is provided separately from the image exposure device 1. The standard light source 13 emits the light to the surface of the photosensitive drum to perform the whole surface exposure. The charging current value detected when the contact charging member 3 recharges the exposed area on the surface of the photosensitive drum is determined as the first charging current value Ico.

At this time, it is desirable for the standard light source 13 to emit the quantity of light equal to the quantity of light emitted from the image exposure device 1 which forms an electrostatic latent image in the image-forming period. The light quantity, however, may be different. Effective results can be obtained so long as the light quantity that satisfies Ico±25% is used with respect to the charging current value Ico when the photosensitive drum 2 is exposed to the light having a light quantity equal to the image exposure device 1 in the image-forming period.

Since other components and control of the present exemplary embodiment are similar to those of the first exemplary embodiment, the components are given the same reference numerals and their detailed description will not be repeated.

According to the above-described exemplary embodiments, the photosensitive member 2 is not limited to a drum-shaped photosensitive member, and a flexible and rotatable photosensitive member in an endless belt shape can be used. Further, the form of the contact charging member 3 is not limited to a roller and may also be a blade, a brush, or the like The pre-charge exposure device 12 can be arranged downstream of the cleaning device 5 and upstream of the contact charging member 3 in the rotation direction of the photosensitive drum 2 to perform whole surface exposure of the photosensitive drum surface. In this case, the formation of ghost image can be prevented. Further, since whole surface exposure by the pre-charge exposure device 12 is performed after removal of the residual transfer toner by the cleaning device 5, there will be no toner scattering.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2007-334012 filed Dec. 26, 2007 and No. 2008-242197 filed Sep. 22, 2008, which are hereby incorporated by reference herein in its entirety.

What is claimed is:

1. An image forming apparatus comprising:

a rotatable electrophotographic photosensitive member;

a contact charging member configured to charge a surface of the rotatable electrophotographic photosensitive member by contacting the rotatable electrophotographic photosensitive member;

a charging current detection device configured to detect a current value that flows through the contact charging member;

a pre-charge exposure device configured to remove a residual charge by exposing the surface of the rotatable electrophotographic photosensitive member to light before the rotatable electrophotographic photosensitive member is charged by the contact charging member;

a standard exposure device adjusted to emit light of a predetermined light quantity and configured to expose the surface of the rotatable electrophotographic photosensitive member to the light; and a control device configured to control, in a non-image-forming period, the charging current detection device to detect a first current value which flows through the contact charging member when an area on the surface of the rotatable electrophotographic photosensitive member is recharged by the contact charging member, in a case where the rotatable electrophotographic photosensitive member which is charged by applying a predetermined voltage by the contact charging member is exposed by turning on the standard exposure device without turning on the pre-charge exposure device, to control, in the non-image-forming period, the charging current detection device to detect a second current value which flows through the contact charging member when an area on the surface of the rotatable electrophotographic photosensitive member is recharged by the contact charging member, in a case where the rotatable electrophotographic photosensitive member which is charged by applying a predetermined voltage by the contact charging member is exposed by turning on the pre-charge exposure device without turning on the standard exposure device, and to determine light quantity of the pre-charge exposure device based on the first current value and the second current value.

2. The image forming apparatus according to claim 1, wherein the control device detects a plurality of the second current values which flow through the contact charging member when the rotatable electrophotographic photosensitive member which is charged to a predetermined potential by the contact charging member is exposed a plurality of times to lights having different light quantity by turning on the pre-charge exposure device without turning on the standard exposure device, and a plurality of areas on the surface of the rotatable electrophotographic photosensitive member which have been exposed to the lights having different light quantity are recharged by the contact charging member.

3. The image forming apparatus according to claim 1, wherein the control device determines the light quantity of the pre-charge exposure device based on the second current value while a ratio of the second current value to the first current value is within a predetermined range.

4. The image forming apparatus according to claim 1, wherein the standard exposure device is a laser exposure device having an automatic power control function.

5. The image forming apparatus according to claim 1, wherein the pre-charge exposure device is a light-emitting diode (LED) exposure device.

6. The image forming apparatus according to claim 1, wherein the standard exposure device is an image exposure device configured to form an electrostatic latent image on the surface of the rotatable electrophotographic photosensitive member, and further comprising a development device configured to develop the electrostatic latent image.

7. The image forming apparatus according to claim 6, wherein the light quantity of the standard exposure device used in obtaining the first current value is equal to or within ±25% of the light quantity of the image exposure device configured to form the electrostatic latent image when the electrostatic latent image is formed.

8. The image forming apparatus according to claim 1, wherein the light quantity of the pre-charge exposure device is smaller than the light quantity of the image exposure device configured to form an electrostatic latent image on the surface of the rotatable electrophotographic photosensitive member when the electrostatic latent image is formed.

* * * * *